US006813784B1

(12) United States Patent
Thompson

(10) Patent No.: US 6,813,784 B1
(45) Date of Patent: Nov. 9, 2004

(54) SANITARY TOILET SEAT PROTECTOR

(75) Inventor: Ray Merrill Thompson, Fairfield, CT (US)

(73) Assignee: Sensible Concepts, LLC, Southport, CT (US)

( * ) Notice: Subject to any disclaimer, the term of this patent is extended or adjusted under 35 U.S.C. 154(b) by 0 days.

(21) Appl. No.: 10/345,027

(22) Filed: Jan. 15, 2003

(51) Int. Cl.[7] ..... A47K 13/14
(52) U.S. Cl. ..... 4/245.1; 4/245.4; 4/245.8
(58) Field of Search ..... 4/239, 245.1, 245.3–245.6, 4/245.8, 245.9

(56) References Cited

U.S. PATENT DOCUMENTS

| | | | | |
|---|---|---|---|---|
| 1,036,623 A | | 8/1912 | Hopkinson | |
| 1,108,460 A | | 8/1914 | Messick et al. | |
| 1,601,088 A | * | 9/1926 | Sullivan et al. | 4/245.3 |
| 1,713,062 A | | 5/1929 | Van Ling | |
| 2,156,035 A | | 4/1939 | Toohy | |
| 2,312,589 A | | 3/1943 | Reeves | |
| 2,313,311 A | | 3/1943 | Arter, Jr. et al. | |
| 3,102,276 A | * | 9/1963 | Warnberg | 4/245.5 |
| 4,050,105 A | | 9/1977 | Marceaux | |
| 4,744,113 A | * | 5/1988 | Kogut | 4/245.1 |
| 4,766,617 A | | 8/1988 | Thygesen et al. | |
| 4,875,242 A | * | 10/1989 | Albrecht et al. | 4/245.4 |
| 4,975,990 A | | 12/1990 | Chan | |
| 5,216,760 A | | 6/1993 | Brown et al. | |
| 5,392,469 A | | 2/1995 | Adams | |
| 5,537,693 A | | 7/1996 | Dossola et al. | |
| 5,557,809 A | | 9/1996 | Adams | |
| 5,729,838 A | * | 3/1998 | Schweizer | 4/245.8 |
| 5,987,656 A | | 11/1999 | Kakutani | |
| 6,073,274 A | | 6/2000 | McQueen | |

FOREIGN PATENT DOCUMENTS

FR 2623706 A1 * 6/1989 ..... A47K/13/18

OTHER PUBLICATIONS

PottyTopper Website Article, 2 Pages, www.tabletopper.com/NSPotty.htm, Sep. 30, 2002.

* cited by examiner

*Primary Examiner*—Tuan Nguyen
(74) *Attorney, Agent, or Firm*—Fattibene & Fattibene; Paul A. Fattibene; Arthur T. Fattibene

(57) ABSTRACT

A toilet seat cover providing sanitary protection having side flaps and a front expansion fold. A toilet seat cover made of a paper material is oversized to cover a toilet seat. Side hand flaps extend below the toilet seat and permit easy grasping of the toilet seat by a user, especially children, in stabilizing or positioning on the toilet seat. A front expansion fold permits the toilet seat cover to accommodate different sized toilets. Adhesive material may also be placed on the bottom of the toilet seat cover to prevent slipping on a toilet seat. The toilet seat cover may be folded and packaged with a disinfectant wipe, providing a convenient package for carrying and use. The present invention is suitable for use by children and adults.

18 Claims, 5 Drawing Sheets

SANITARY TOILET SEAT PROTECTOR

FIELD OF THE INVENTION

The present invention relates in general to sanitary protection, and more particularly to a toilet seat cover preventing bodily contact with the toilet seat during use.

BACKGROUND OF THE INVENTION

Restrooms, and in particular public restrooms, are often unsanitary and potentially unhealthy. There are many different sanitary toilet seat covers used to avoid the unsanitary and potentially unhealthy contact with a toilet seat during use. One such toilet seat cover is disclosed in U.S. Pat. No. 6,073,274 entitled "Sanitary Toilet Seat Cover" and issuing to McQueen on Jun. 13, 2000. Therein disclosed is a sanitary toilet seat cover that has a waterproof material affixed to a layer of porous material impregnated with an antibacterial solution. Adhesive patches are also used to temporarily affix the seat cover to a toilet seat. Another toilet seat cover is disclosed in U.S. Pat. No. 4,975,990 entitled "Disposable Splash Suppressing Toilet Seat Cover With Folded Annular And Bridging Inner Portions" issuing to Chan on Dec. 11, 1990. Therein disclosed is a splash suppressing toilet seat cover made of paper. A zigzag or fanfold portion extends across the center portion. Another sanitary toilet seat cover is disclosed in U.S. Pat. No. 1,036,623 entitled "Sanitary Toilet Shield" issuing to Hopkinson on Aug. 27, 1912. Therein disclosed is a shield or protector that has a blank or tongue-like forming member being turned or folded back under the seat sitting portion.

While these prior sanitary toilet seat covers have been advantageously used to prohibit contact with a toilet seat during use, they have often been of complicated structure. Also they are typically difficult to use or position on the variety of sizes of toilet seats. Additionally, many of the prior sanitary toilet seat covers have not been easily adapted to different size toilets. The prior sanitary toilet seat covers also have not been suitable in protecting children who often have to hold onto the toilet seat during use, from contact with the seats.

Accordingly, there is a need for an improved toilet seat cover that can easily be adjusted to different size toilet seats and that is adapted for use by children.

SUMMARY OF THE INVENTION

The present invention comprises a protective toilet seat cover that is oversized and can easily be adjusted for different size toilet seats, as well as providing for holding the sides of the toilet without touching the toilet directly. An oversized seat portion has a front expansion fold therein and side hand flaps. Adhesive may be used on a rear portion of the toilet seat cover, permitting the front seat portion to move. In another embodiment, adhesive may be sprayed on the entire underside of the toilet seat cover. Interior flaps are formed by slits that hang downward into the toilet bowl. A hand icon or symbol may be placed on the hand flap. Decorative indicia may also be printed on the seat cover. The protective seat cover may be folded and packaged together with a disinfectant wipe for convenience of use. The toilet seat cover is easily flushable after use requiring little or no human contact with the cover or the seat after use.

Accordingly, it is an object of the present invention to provide protection from contamination due to contact with a toilet seat.

It is another object of the present invention to provide a toilet seat cover that can accommodate different sized toilets.

It is an advantage of the present invention that small children and adults can hold onto the side of a toilet without having to directly contact the toilet.

It is another advantage of the present invention that the underside of the protective seat cover is coated with a light adhesive to prevent slipping and sliding once the cover is in place.

It is a feature of the present invention that there is a front expansion fold for expanding the front portion of the toilet seat cover.

It is another feature of the present invention that side flaps extend below the toilet seat permitting young children to hold the toilet on the sides without directly contacting the toilet seat.

These and other objects, advantages, and features will become more readily apparent in view of the following detailed description.

DETAILED DESCRIPTION OF THE PREFERRED EMBODIMENTS

Figure 1:
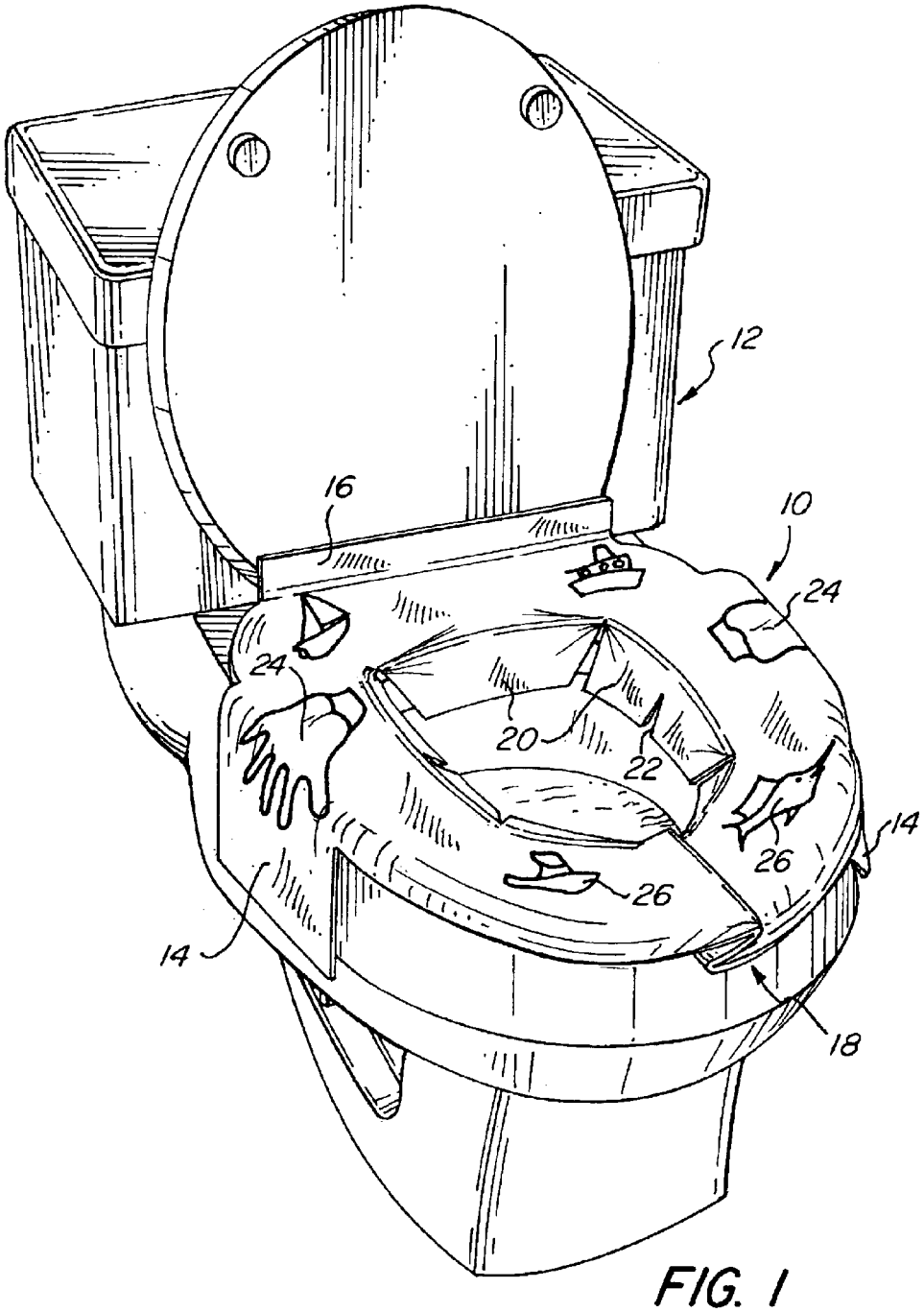
FIG. 1 is a perspective view of the present invention in place on a toilet seat.

FIG. 1 illustrates a protective toilet seat cover 10 placed on the seat of a toilet 12. The oversized toilet seat cover 10 hangs over the toilet seat. Side hand flaps 14 extend substantially below the seat portion 11. A rear flap 16 extends vertically upward. Front expansion fold 18 has excess material permitting the seat portion 11 to expand, accommodating different size toilets. A central opening has interior flaps 20 which are formed from slits 22. The interior flaps 20 hang downward into the interior of the toilet 12. Hand icons or symbols 24 may be placed on the seat portion 11 and the hand flaps 14. Decorative indicia 26 may also be placed on the seat portion 11 or hand flaps 14. The decorative indicia 26 may be of any character or shape. The decorative indicia may be particularly suited to children. Other decorative indicia may be used for adults. Adhesives may also be used to prevent sliding of the toilet seat cover 10 on the toilet 12.

Figure 2:
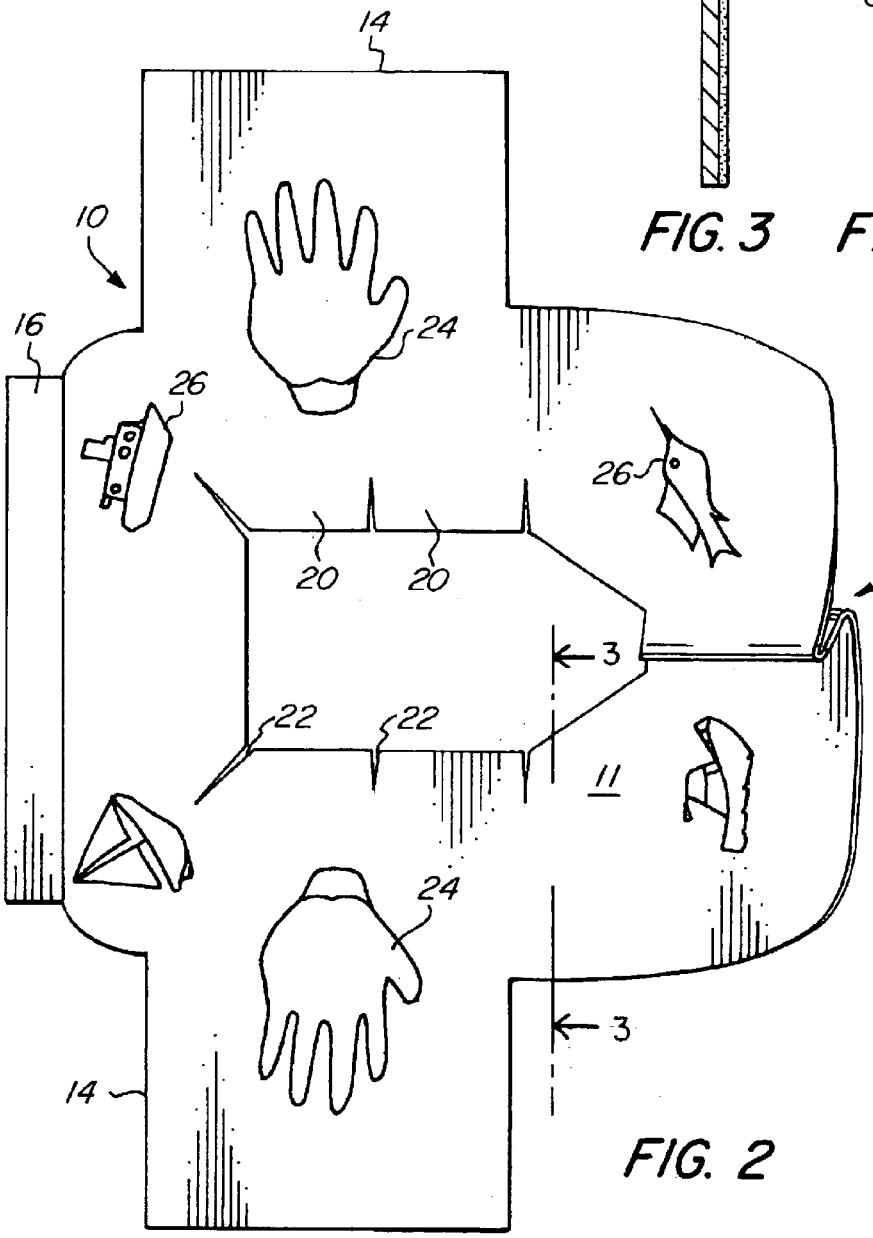
FIG. 2 is a plan view of one embodiment of the present invention.

FIG. 2 is a plan view clearly illustrating the toilet seat cover 10. The side hand flaps 14 extend a substantial distance laterally and downward from the seat portion 11 and extend only a portion longitudinally along the seat portion 11. The longitudinal length of the side hand flaps 14 is less than the longitudinal length of the seat portion 11. The hand flaps 14 permit a child, young adult, or adult to hold onto the sides of the toilet without directly touching the toilet 12.

Figure 3:
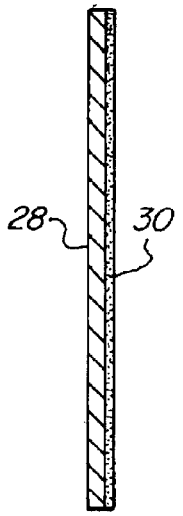
FIG. 3 is a cross section taken along line 3—3 in FIG. 2.

FIG. 3 is a cross section taken along line 3—3 in FIG. 2. FIG. 3 illustrates the structure of the toilet seat cover. A paper material 28 has an adhesive or tacky material coating 30 thereon. The adhesive or tacky material coating 30 prevents the toilet seat cover from sliding on the toilet seat. The adhesive or tacky material coating may cover the entire underside surface of the toilet seat cover 10, illustrated in FIG. 2, which comes in contact with the toilet seat or only a portion thereof. The adhesive may be sprayed on. The adhesive or tacky material coating 30 need not cover the entire surface of the toilet seat protector 10, but only a portion thereof. The side hand flaps 14 are preferably not coated with the adhesive or tacky material coating 30. The portion that are not coated with adhesive, such as the side hand flaps 14 and the front portion having the expansion fold 18, may be used when folded over to protect the adhesive coated portions.

The paper material 28 may be a soft cushion constructed of a material similar to household toilet paper. The paper material 28 may be one or multiple ply paper or other fibrous material. The paper material 28 should be disposable, hypoallergenic, and biodegradable. The paper material 28 should be readily flushable. The paper material 28 may also be treated with an antibacterial agent for further germicidal protection.

Figure 4:
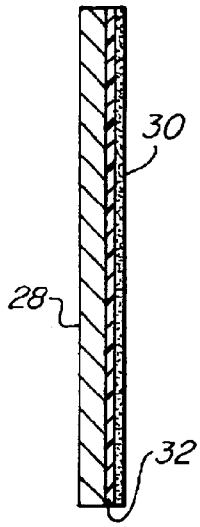
FIG. 4 is a cross section of another embodiment of the present invention.

FIG. 4 illustrates another embodiment of having a different construction for the toilet seat cover. A paper material 28 may have a moisture barrier layer 32 and an adhesive tacky material coating 30 placed thereon. The moisture barrier layer 32 prevents any moisture that may be on the toilet seat from soaking through to the absorbent paper material 28.

Figure 5:
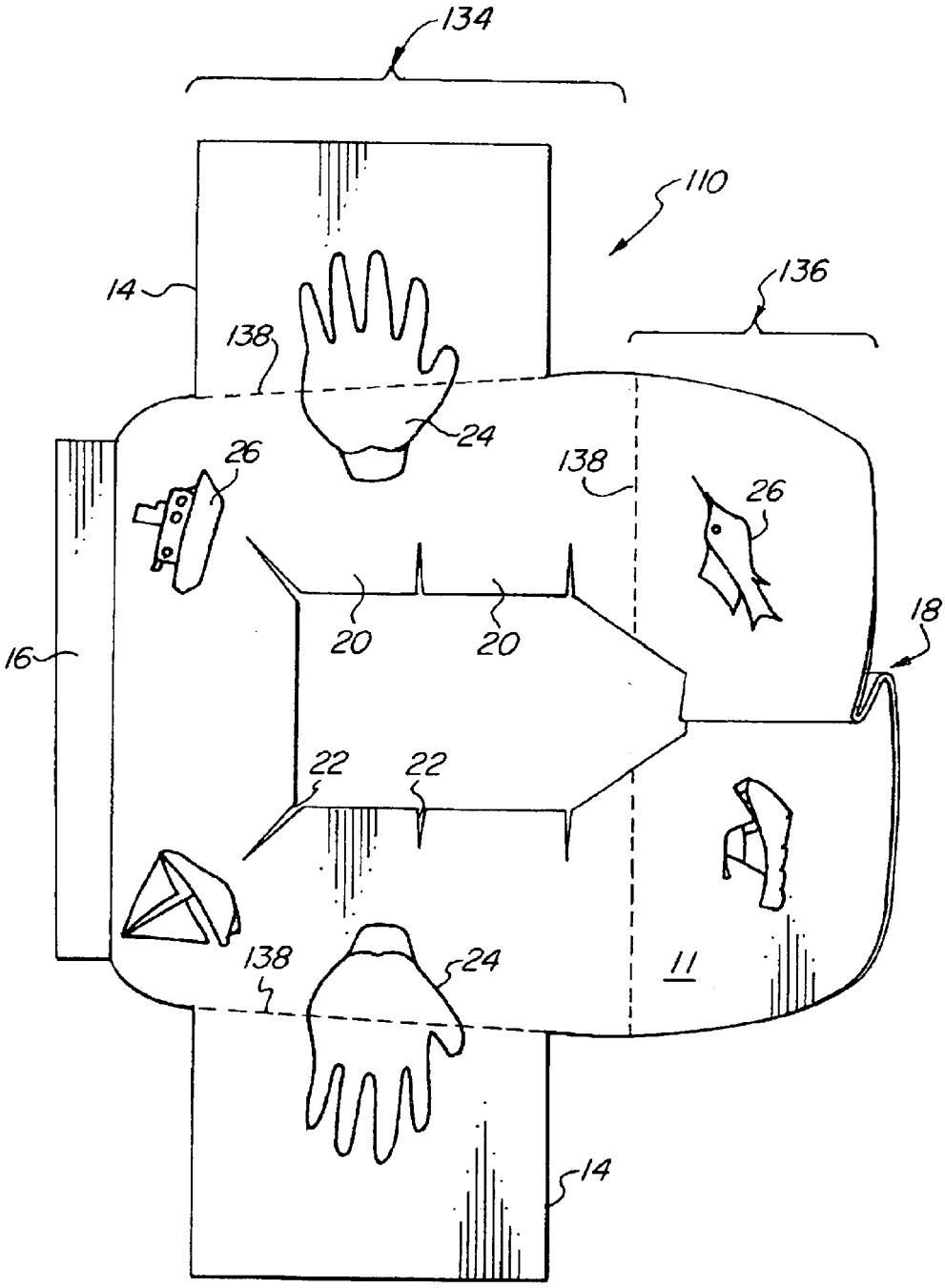
FIG. 5 is a plan view of another embodiment of the present invention illustrating the placement of an adhesive.

FIG. 5 is a plan view of another embodiment of the invention. In this embodiment, a rear adhesive portion 134 of the toilet seat cover 110 has an adhesive material coated thereon and a front non-adhesive portion 136 without any adhesive material coated thereon. The adhesive is bounded within an area formed by adhesive lines 138. The adhesive is not placed on the hand flaps 14. The front non-adhesive portion 136 permits the expansion of the front expansion fold 18. It should be appreciated that while the adhesive or tacky material may be coated on the surface of the seat portion 11 contacting the toilet seat, adhesive strips may also be used within the area bounded by the adhesive lines 138. Additionally, the adhesive portion may cover any portion of the seat portion 11 so that the front non-adhesive portion 136 and the flaps 14 may be folded over protecting the rear adhesive portion 134 until ready for use. The adhesive or tacky material coating may be any releasable type adhesive or tacky material that creates relatively high friction between the toilet seat cover 110 and the toilet seat so as to prevent the toilet seat cover 110 from sliding off the toilet seat.

Figure 6:
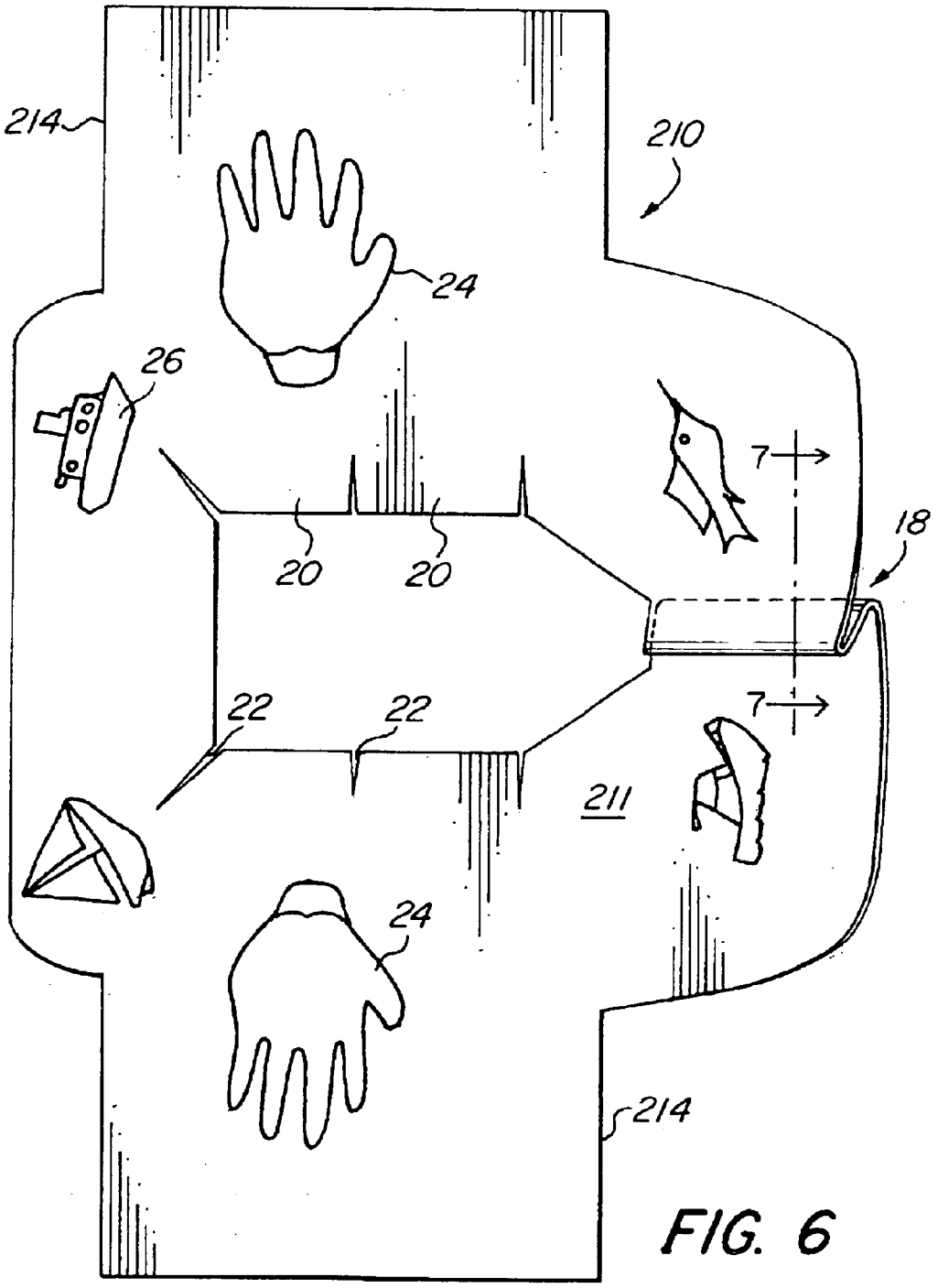
FIG. 6 is a plan view of yet another embodiment of the present invention illustrating enlarged side flaps.

FIG. 6 illustrates another embodiment of the present invention having enlarged side hand flaps. In this embodiment, the toilet seat cover 210 has enlarged hand flaps 214. The enlarged hand flaps 214 extend a substantial portion longitudinally along the toilet seat cover 210. The extended side hand flaps,214 may extend more than one half of the longitudinal length or depth of the entire toilet seat cover 210. This provides increased protection, as well as permits more room to hold onto the sides of the toilet. Therefore, the extended hand flaps 214 extend a substantial longitudinal distance along the seat portion 211.

Figure 7:
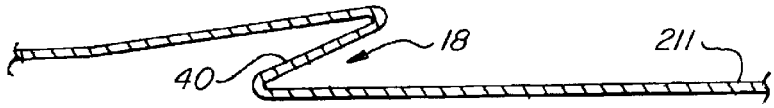
FIG. 7 is a cross section taken along lines 7—7 in FIG. 6.

FIG. 7 is a cross section taken along lines 7—7 in FIG. 6 and illustrates the Z-fold 40 forming a front expansion fold 18. The Z-fold 40 of the front extension fold 18 is formed integrally within the material of the seat portion 211.

Figure 8:
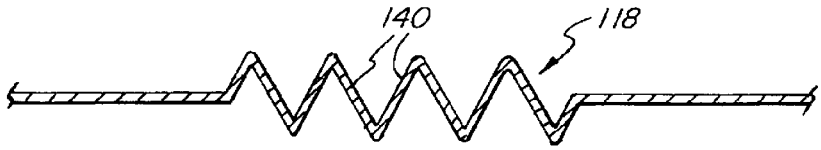
FIG. 8 is a cross section illustrating another embodiment of a front expansion fold.

FIG. 8 illustrates another embodiment of a front expansion fold 118. In this embodiment, an accordion fold 140, having multiple folded portions, is used in forming the front expansion fold 118.

Figure 9:
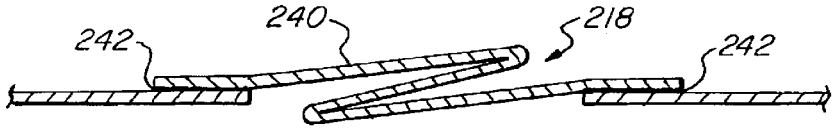
FIG. 9 is a cross section illustrating another embodiment of a front expansion fold.

FIG. 9 illustrates yet another embodiment in forming a front expansion fold 218. In this embodiment, an insert Z-fold 240 is bonded to a seat portion by adhesive 242.

The front expansion fold may be made of a variety of other known different equivalent expansion structures so as to provide means for expanding so as to accommodate different size toilets.

Figure 10:
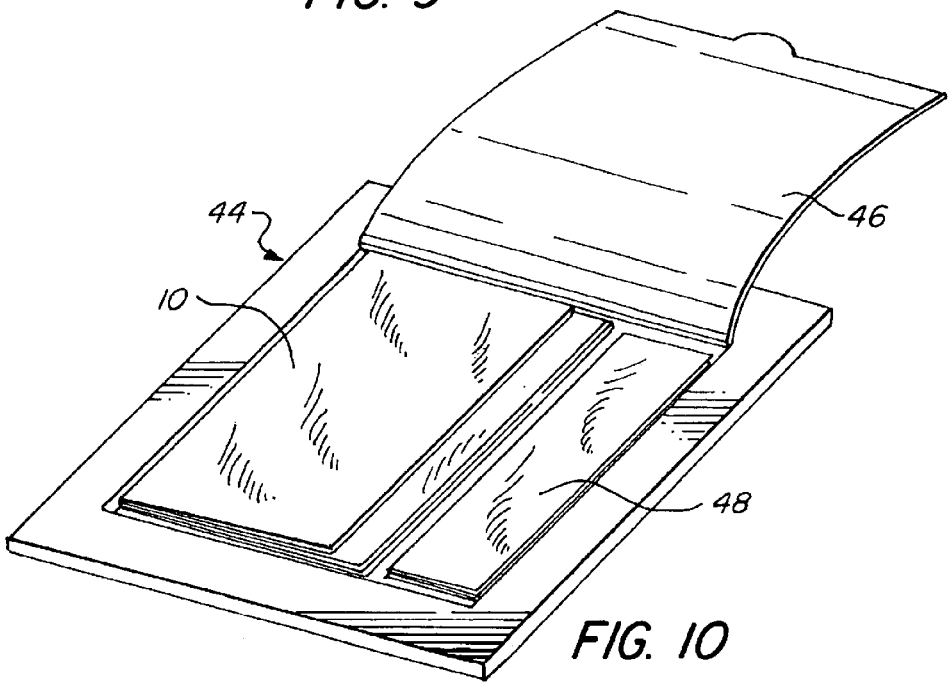
FIG. 10 is a perspective view illustrating a package for containing a protective toilet seat cover and a disinfecting wipe.

FIG. 10 illustrates an embodiment of the present invention in which a toilet seat cover 10 is packaged together with a disinfectant wipe 48. The toilet seat cover 10 is folded into a small size. The package 44 is sealed with a removable cover 46. The package 44 may be formed of any suitable material such as a plastic bag or paper container. A resealable plastic bag may also be used as a package. The resealable plastic bag may have a zip-lock type seal. Disinfectant wipe 48 may be used to clean the toilet seat and area and the protective toilet seat cover 10 unfolded and placed into position on the toilet seat.

The present invention has many advantages and is particularly well suited for use by small children. The present invention may be used in the many situations where public restrooms are not sanitary and potentially unhealthy. Additionally, by being oversized and having a front expansion fold, the present invention fits over many commercial toilet seats and provides hand flaps for children to place their hands without directly contacting the toilet seat. The front expansion fold permits expansion of up to at least three inches or about seven centimeters to accommodate different size toilets. Additionally, colorful and child friendly designs for both boys and girls may be printed on the toilet seat cover. Designs suitable for adults may also be printed on the toilet seat cover.

Children can also use the toilet seat covers as part of a process of developing a consistent routine of using a toilet. The present invention therefore can reduce any apprehension a child sometimes experiences when using a toilet in unfamiliar environments.

While the present invention may be utilized in a variety of different dimensions, preferably the toilet seat cover measures 20.25 inches long by 26 inches wide or about 51.5 cm by 66.0 cm so as to accommodate commercial and noncommercial toilet seats. The toilet seat portion, not including the hand flaps, is approximately 20.25 inches or 51.5 cm long by 14 inches or 35.5 cm wide. The toilet seat cover, from the back of the seat to the opening in the middle of the toilet, preferably measures about 6 inches or 15 cm. The interior opening in the center of the protective toilet seat cover is preferably 10.25 inches long or about 26.0 cm. For approximately 5 inches or about 13 cm of the opening length, the width is approximately 5 inches or about 13 cm. The interior opening may then narrow down towards the front to about 1.50 inches or 4 cm wide. The center of the toilet seat cover may have six interior slits allowing the opening to fold into the interior of the toilet, further protecting from direct contact with the toilet seat. Preferably, the four slits are about 1 inch or 2.54 cm long with the two in the rear being about 1.50 inches or 4 cm long. The hand flaps may be approximately 12 inches long by 6 inches wide or 30.5 cm by 15.2 cm and begin approximately 3.5 inches or 9 cm from the back or rear and end approximately 3.25 inches or 8.3 cm from the front.

While the present invention has been described with respect to several embodiments, it should be appreciated by those skilled in the art that various modifications may be made without departing from the spirit and scope of this invention.

What is claimed is:

1. A protective toilet seat cover comprising:

a seat portion having decorative indicia visibly printed thereon adapted to be placed on a toilet seat, said seat portion having a longitudinal length and a front portion; and a hand flap extending laterally from opposing sides of said seat portion and adapted to hang downward adjacent a toilet seat, said hand flaps having a longitudinal length less than the longitudinal length of said seat portion, said hand flaps having an icon of a hand printed thereon, whereby a user may place their hands on said hand flaps to hold the toilet seat.

2. A protective toilet seat cover as in claim 1 further comprising:

an expansion fold formed within the front portion only of said seat portion.

3. A protective toilet seat cover as in claim 1 further comprising:

adhesive placed on said seat portion.

4. A protective toilet seat cover comprising;

a seat portion adapted to be placed on a toilet seat, said seat portion having a front portion, a front expansion fold formed within said seat portion on the front portion only, seat, said hand flaps have an icon of a hand printed thereon, said front expansion fold capable of expanding at least three inches or about seven and one half centimeters; and hand flaps extending from said seat portion and adapted to hang downward adjacent the toilet seat, whereby the protective toilet seat cover is readily adapted to a variety of different toilet seats and a user may hold the sides of the toilet without directly contacting the toilet.

5. A protective toilet seat cover as in claim 4 further comprising:

decorative indicia printed on said seat portion.

6. A protective toilet seat cover as in claim 4 further comprising:

adhesive placed on said seat portion.

7. A protective toilet seat cover as in claim 4 further comprising:

adhesive placed on a rear portion of said seat portion.

8. A protective toilet seat cover as in claim 4 wherein:

the protective toilet seat cover is made of a paper.

9. A protective toilet seat cover as in claim 8 wherein:

said paper is capable of being flushed.

10. A protective toilet seat cover as in claim 4 further comprising:

interior flaps formed by slits formed in an interior opening of said seat portion.

11. A disposable protective toilet seat cover adapted to fit different size toilet seats comprising:

a seat portion adapted to be placed on a toilet seat, said seat portion having a longitudinal length and a front portion;

a hand flap extending laterally from opposing sides of said seat portion and adapted to hang downward adjacent a toilet seat, said hand flaps having a longitudinal length less than the longitudinal length of said seat portion and an icon of a hand printed thereon, whereby a user may place their hands on said hand flaps to hold the toilet seat;

a front expansion fold formed in the front portion only of said seat portion, said front expansion fold permitting said seat portion adjacent said front expansion fold to expand, whereby different size toilet seats may be accommodated; and an adhesive placed on said seat portion, said adhesive is placed on a rear portion of said seat portion, whereby said adhesive holds said seat portion in position and an adhesive free front portion of said seat portion adjacent said front expansion fold is allowed to move permitting said front expansion fold to expand.

12. A disposable protective toilet seat cover adapted to fit different size toilet seats as in claim 11 wherein:

said front expansion fold comprises a Z-fold capable of expanding at least three inches or about seven and one half centimeters.

13. A disposable paper protective toilet seat cover adapted to fit different size toilet seats comprising:

a seat portion adapted to be placed on a toilet seat, said seat portion having a longitudinal dimension;

a hand flap extending laterally from opposing sides of said seat portion and adapted to hang downward adjacent a toilet seat, said hand flaps having a longitudinal dimension more than half of the longitudinal dimension of said seat portion, whereby a user may place their hands on said hand flaps to hold the toilet seat and stabilize their position;

an icon of a hand printed on said hand flaps;

interior flaps formed by slits adjacent an interior opening, said interior flaps dropping downward into the toilet seat;

a front expansion fold formed in said seat portion, said front expansion fold permitting said seat portion adjacent said front expansion fold to expand at least three inches or about seven and one half centimeters, whereby different size toilet seats may be accommodated; and decorative indicia formed on the disposable paper protective toilet seat cover, whereby the disposable paper toilet seat cover is capable of being adapted to different size toilets and permits a user to hold onto a side of the toilet seat with said hand flaps without directly touching the toilet seat preventing possible contamination.

14. A disposable paper protective toilet seat cover adapted to fit different size toilet seats as in claim 13 further comprising:

an adhesive placed on said seat portion.

15. A disposable paper protective toilet seat cover adapted to fit different size toilet seats as in claim 13 further comprising:

an adhesive placed on a rear portion of said seat portion, whereby said adhesive holds said seat portion in position and an adhesive free portion on a front portion of said seat portion adjacent said front expansion fold is allowed to move permitting said expansion fold to expand.

16. A disposable paper protective toilet seat cover adapted to fit different size toilet seats comprising:

a seat portion adapted to be placed on a toilet seat, said seat portion having a longitudinal dimension of approximately twenty inches and a lateral dimension of approximately fourteen inches;

a hand flap extending laterally from opposing sides of said seat portion and adapted to hang downward adjacent a toilet seat, said hand flaps having a longitudinal dimension of at least twelve inches and a lateral dimension of at least six inches, whereby a user may place their hands on said hand flaps to hold the toilet seat and stabilize their position;

an icon of a hand printed on said hand flaps;

an interior opening formed within said seat portion, said interior opening having a longitudinal dimension of approximately ten inches and a maximum lateral dimension of approximately five inches;

interior flaps formed by slits adjacent said interior opening, said interior flaps dropping downward into the toilet seat;

a front expansion fold formed in said seat portion, said front expansion fold permitting said seat portion adjacent said front expansion fold to expand at least three inches or about seven and one half centimeters, whereby different size toilet seats may be accommodated; and decorative indicia formed on the disposable paper protective toilet seat cover, whereby the disposable paper toilet seat cover is capable of being adapted to different size toilets and permits a user to hold onto a side of the toilet seat with said hand flaps without directly touching the toilet seat preventing possible contamination.

17. A disposable paper protective toilet seat cover adapted to fit different size toilet seats as in claim 16 further comprising:

an adhesive placed on said seat portion.

18. A disposable paper protective toilet seat cover adapted to fit different size toilet seats as in claim 16 further comprising:

an adhesive placed on a rear portion of said seat portion, whereby said adhesive holds said seat portion in position and an adhesive free portion on a front portion of said seat portion adjacent said front expansion fold is allowed to move permitting said expansion fold to expand.

* * * * *